US005316252A

United States Patent [19]

Charnow et al.

[11] Patent Number: 5,316,252

[45] Date of Patent: May 31, 1994

[54] UNIQUE EYEGLASS HOLDER FOR DISPLAYS

[75] Inventors: Morris Charnow, Jericho; Frederick Manners, Long Island, both of N.Y.

[73] Assignee: Avant-Garde Optics, Inc., Port Washington, N.Y.

[21] Appl. No.: 890,873

[22] Filed: Jun. 1, 1992

[51] Int. Cl.[5] ..... A47F 7/00

[52] U.S. Cl. ..... 248/223.4; 248/902; 248/309.1; 211/13

[58] Field of Search ..... 248/223.4, 224.2, 224.1, 248/221.4, 221.3, 902, 309.1, 231.8, 224.3, 224.4; 211/13, 87

[56] References Cited

U.S. PATENT DOCUMENTS

| | | | |
|---|---|---|---|
| Re. 33,596 | 5/1991 | Ennis | 248/225.1 X |
| 1,787,734 | 1/1931 | Rowling | 248/224.1 X |
| 2,997,270 | 8/1961 | Farndon | 248/902 X |
| 3,229,944 | 1/1966 | Everburg | 248/902 X |
| 3,278,146 | 10/1966 | Simon | 248/221.4 X |
| 4,204,602 | 5/1980 | Dunchock | 248/902 X |
| 4,909,464 | 3/1990 | Levine et al. | 248/221.4 X |
| 5,056,668 | 10/1991 | Berger | 248/902 |
| 5,069,416 | 12/1991 | Ennis | 248/902 |

*Primary Examiner*—Karen J. Chotkowski

*Attorney, Agent, or Firm*—Lerner, David, Littenberg, Krumholz & Mentlik

[57] ABSTRACT

The present invention is an eyeglasses holder which forms a detachable coupling between a flat base and a nosepiece. The flat base has front channels for accommodating an interlocking wedge structure of the nosepiece to provide the detachable coupling. The nosepiece comprises an A-shaped frame structure and a pair of interlocking wedges, where each interlocking wedge is connected to the A-shaped frame structure by an interconnecting shaft. The pair of interlocking wedges can be slid into the front channels of the flat base and locked therein by a pair of small protrusions. The two interconnecting shafts can be squeezed inwardly to cause the pair of interlocking wedges to shift and avoid the small protrusions, so that the pair of interlocking wedges can be released from the front channels of the flat base. The present invention is also a multiplicity of eyeglass holders each being detachably assembled by a base piece and a noise piece as described above.

20 Claims, 3 Drawing Sheets

UNIQUE EYEGLASS HOLDER FOR DISPLAYS

BACKGROUND OF THE INVENTION

1. Field of the Invention

This invention is generally related to the field of eyeglass holders. More specifically, the present invention is related to the field of eyeglass holder with detachable interlocking members that hold eyeglasses on a display surface. The interlocking members of the eyeglass holder securely lock into place and are easily detached.

2. Description of the Prior Art

The present invention is an eyeglass holder which is designed to hold eyeglasses on a display. There are two pieces to the present invention, a flat base and a nosepiece. The two pieces detachably interlock, providing an eyeglass holder which is efficiently shipped and easily replaced or upgraded in a display.

The inventor is aware of prior art eyeglass displays that are made of one piece. In the one piece eyeglass display, the base and the entire nosepiece are of one unit and are glued onto the flat base plate. These prior art eyeglass displays often involve a multiplicity of eyeglass holder on the same base plate.

One of the problems which the present invention addresses is that eyeglass holders are usually very delicate and can break or chip easily during shipping. Shipping a set of eyeglass holders is very bulky and frequently the nosepieces are damaged and break off the base because of rough handling during shipment. Breakage of one of the individual eyeglass holder can ruin the entire display.

Another problem which the present invention addresses is the eyeglass holders can often break while eyeglasses are on display. In the one piece eyeglass display, the entire set of eyeglass holders would need replacement. In addition, it is often necessary for the eyeglass retailer to update certain selections of a display with differing eyeglass holders which are suitable for a specific type of eyeglasses. Replacing specific eyeglass selections would require that the entire set of eyeglass holders on the base plate be replaced. Replacing the entire set of eyeglass holders for a limited number of different types of eyeglasses is a costly and inefficient procedure.

Therefore, there is a significant need for an improved detachable nosepiece to avoid this breakage problem.

SUMMARY OF THE PRESENT INVENTION

The present invention is a unique eyeglass holder which is contained in two parts. The first piece is a flat base, which can attach to a wall, a display plate, or any other flat surface for purposes of displaying and holding the second piece. The second piece is a nosepiece which easily attaches to the flat base. The nosepiece disengageably snaps into the flat base. The combination of the flat base and the nosepiece supports the nose of the eyeglasses with the temples of the eyeglasses folded back.

By providing the eyeglass holders in a two piece configuration, several problems which are present in a one piece design, are overcome. One of the problems of a one piece design is in shipping. During shipping and handling, breakage can often occur to one of the eyeglass holders. When all eyeglass holders are directly mounted to a single plate, the breakage of one eyeglass holder can ruin the entire rack. By having a two piece design, the parts can be shipped and handled more easily, with a less bulky packing arrangement. In addition, in the event of the breakage of any of the eyeglass holders, the part could be easily replaced.

The present invention has solved the shipping and breakage problems of the prior art with a unique removable nosepiece which is held onto the flat base. Before shipping, a multiplicity of flat bases are in a spaced apart arrangement and glued onto a larger base plate. The larger base plate can be shipped in a simple flat container and the nosepieces can be separately shipped and packaged with paper or bubble shipping material.

The eyeglass holders can be easily shipped to the destination and then assembled into one-piece units where the removable nosepiece slides into the base and is retained therein. This substantially reduces breakage and also makes shipping much easier and less costly.

The present invention is generally utilized in such a manner that there can be any multiplicity of such bases as described above and separated from one another so that there is a row of 30 or 50 or 100 or more of these pieces on a larger flat surface.

The present invention comprises two separate pieces which detachably interlock. There is a flat base and a nosepiece. The flat base is oriented vertically and the nosepiece is connected to the flat base in a fit which clicks into place.

Once the nosepiece is clicked into place, the nosepiece faces projecting out horizontally from the vertically disposed flat base with an A-frame structure in an inverted position. The nose of the eyeglass rests on the A-frame with the temples of the eyeglass folded and resting on the back portion.

Among the uniqueness in addition to having a removable base is the way that the removable nosepiece is attached to the flat base. There are rectangular sliding plates which fit into channels in the flat base. The rectangular sliding plates are secured by small hemispherical dots which block the edge of the rectangular plate from sliding out of the channel.

To attach the nosepiece to the flat base, the rectangular sliding plates of the nosepiece are slid into the channels of the mounting piece and then locked in place by the two small hemispherical dots which are placed at the entrance to the channel of the mounting piece. The nosepiece is retained therein and cannot fall out. If it is desired to remove the nosepiece, then the two vertical posts are squeezed together slightly so that they overcome the compressive force of the tight fit of the channel and are raised slightly above the height of the two small hemispherical dots so that they can then be slid out.

The two piece interlocking design of the eyeglass holder provides the advantage that when in use, if a nosepiece breaks, it can easily be slid out from its base and replaced with a new nosepiece without the necessity of having to replace an entire panel.

Each eyeglass holder has a flat base which can be placed anywhere on a flat plate or a wall in a vertical position. The nosepiece interlocks to the flat base. If the nosepiece is damaged or broken, the nosepiece can be easily slid out of the flat base and replaced with another nosepiece. Although the nosepiece of the present invention is adaptable to a very large variety of styles and models of eyeglasses, differently designed nosepieces could be fitted to the same flat bases.

The fit between the flat base and the nosepiece is accomplished by means of two rectangular sliding plates from the nosepiece which fit into channels at the flat base. The channels are formed by two narrow grasping channels of the flat base, which dovetail the lateral edges of the two interlocking wedges of the nosepiece.

The fit is held securely by the fact that the sliding plates are squeezed together in a slight compression when placed into the channels of the flat base. There are very small hemispherical dots which are positioned at the entrance to the channels of the flat base so that when the interlocking wedge structures are pushed into the channels, over the hemispherical dots, the wedge structures extend into the channels sufficiently far that the hemispherical dots prevent withdrawal by blocking the entrance to the channels. In this manner, the wedge structures lock into the channels with a click.

When detaching the nosepiece from the flat base, the rectangular plates which hold the wedge structures are squeezed together, releasing the locked fit, and allowing the nosepiece to be easily slid out of the flat base.

The fit is slightly compressive, made possible due to the elastic properties of the high quality solid plastic material of the nosepiece which exerts a tension on the flat base in response to the compression exerted by the fit to the flat base.

The nosepiece is designed to hold a variety of different eyeglasses. Part of the nosepiece design is an A-frame structure which is separated from the flat base attachment by two shafts which extend horizontally from the flat base attachment of the nosepiece to support the A-frame structure where the eyeglasses are rested upon.

It has been discovered, according to the present invention, that an eyeglasses holder comprised of two pieces could be detachably coupled. The detachable coupling between the flat base and the nosepiece of the eyeglasses holder provides the significant advantage that allows the nosepiece to be easily interchanged or replaced.

It has been further discovered, according to the present invention, that an eyeglasses holder could support the eyeglasses by resting the nose of the eyeglasses on the A-frame structure of the nosepiece and the temples of the nosepiece are folded up behind the A-frame to rest on the shafts which connect to the coupling by a pair of rectangular plates. The support of the eyeglasses is also facilitated by forward and rear flare plates to each lateral side of the A-frame and a pinnacle at the apex of the A-frame.

It has also been discovered, according to the present invention, that a multiplicity of flat base structures could be joined to a mounting plate for a display, where each flat base structure corresponds to a detachable nosepiece structure, and the multiplicity of nosepiece structures holds a retail display of eyeglasses.

It has been additionally discovered, according to the present invention, that the detachable coupling could be constructed by placing channels in the flat base which are adapted to wedge structures at the end of the nosepiece. The wedge structures are held distanced from the A-frame part of the nosepiece by elongated shafts, where the wedge structures are mounted on the end surface of rectangular plate structures connected to the elongated shafts.

It has been further discovered, according to the present invention, that the detachable coupling could be made more secure by locking the wedge structures into the channels with small hemispheric dots which are placed at the entrance of the channels to retain the wedge structures in a fit which locks the wedge structures into place.

It is therefore an object of the present invention to provide an eyeglasses holder comprised of a nosepiece and flat base which are detachably coupled. The detachable coupling between the flat base and the nosepiece provides the significant advantage that the nosepiece can be easily interchanged or replaced.

It is a further object of the present invention to provide an eyeglasses holder which supports the eyeglasses by resting the nose of the eyeglasses on the A-frame structure of the nosepiece and the temples of the nosepiece are folded up behind the A-frame to rest on or above the shafts which are connected to the coupling by a pair of rectangular plates. The present invention facilitates the support of the eyeglasses by means of forward and rear flare plates to each lateral side of the A-frame and a pinnacle at the apex of the A-frame.

It is also an object of the present invention to provide a multiplicity of flat base structures which could be joined to a mounting plate for a display, each flat base structure corresponding to a detachable nosepiece structure, where the multiplicity of nosepiece structures hold a retail display of eyeglasses.

It is an additional object of the present invention to provide the detachable coupling through channels in the flat base which are adapted to wedge structures on the nosepiece. The wedge structures are distanced from the A-frame part of the nosepiece by elongated shafts and the wedge structures are further mounted on the surface of rectangular plate structures.

It is a further object of the present invention to provide a detachable coupling which is made more secure by locking the wedge structures on the surface of the rectangular plates by means of small hemispheric dots which are placed at the entrance of the channels to retain the wedge structures in a click fit where the wedge structures lock into place.

The present invention is not limited to only the usage with eyeglasses, but can be used with any eyewear which is worn on the face such as ski goggles, sunglasses and other eye protection devices for sports activities such as basketball, tennis, and racquetball.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
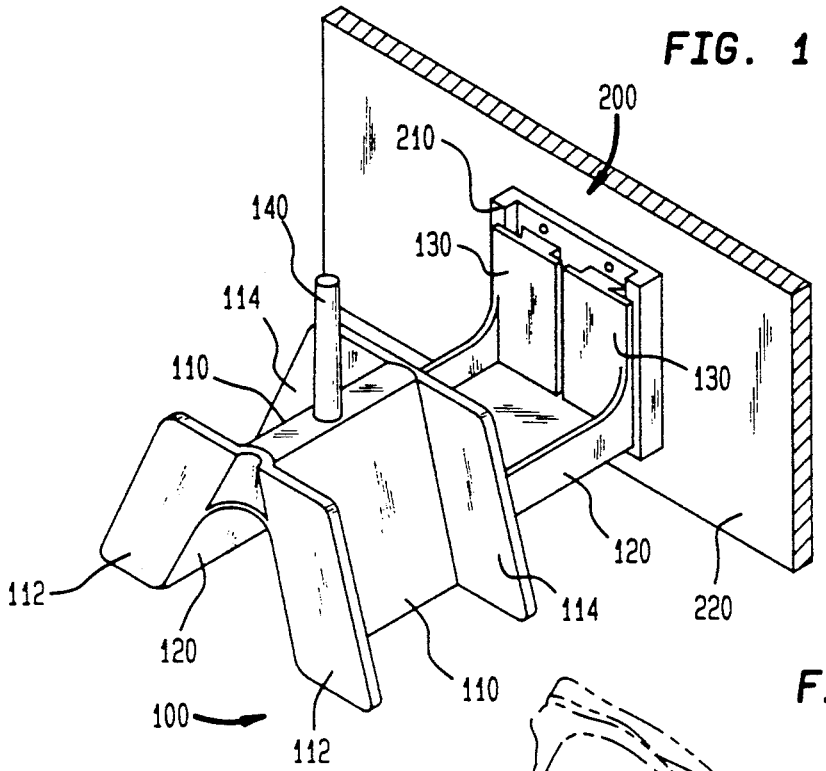
FIG. 1 is a perspective view of the eyeglass holder showing the nosepiece interlocked to the flat base which is mounted to the surface of a plate.

Referring to FIG. 1, there is a perspective view of the eyeglass holder. The flat base 200 is attached to a mounting surface 220. The flat base 200 has a detachable coupling to the nosepiece 100. In practice, the mounting surface 220 can be a large flat display surface. A multiplicity of flat base 200 structures could be arranged on a larger mounting surface 220 so that rows or columns of eyeglasses could be set for a display. The flat display surfaces, with the flat base 200 coupled to the nosepiece 100 could easily be fit into display cases or onto display racks to show eyeglasses in a retail environment.

The flat base 200 and nosepiece 100 could be manufactured in an injection molding process using thermoplastic substances such as high gloss acrylics. The material should have resilient properties to allow a slightly compressed fit. One of the advantages of the present invention is that different nosepieces 100 of various shapes and colors could be interchanges to support eyeglasses of different sizes and styles on display. However, the nosepiece 100 is designed in an extremely versatile manner so that it would accept various sizes of eyeglasses in the embodiment shown.

The nosepiece 100 is connected to the flat base 200. The flat base 200 has a rectangular frame 210 structure at its outer periphery. At the connection of the flat base 200 to the nosepiece 100, there are a pair of rectangular plates 130 which are permanently joined to the shafts 120. The shafts 120 are elongated, narrow beam-like structures which provide support between the A-frame 110 and the rectangular frame 210 of the flat base 200.

The A-frame 110 supports the eyeglasses. There are structures at the side of the A-frame 110 which prevent the eyeglasses from sliding forward or backward. To prevent the eyeglasses from sliding forward, there is a pair of forward flare plates 112 which extend outward, in a common plane perpendicular to the axes of the shafts 120. Similarly, to prevent the eyeglasses from sliding back while they are resting on the A-frame, there are a pair of rear flare plates 114 having surfaces disposed in planes generally parallel to the plane of the forward flare plates 112.

At the apex of the A-frame 110 there is a pinnacle 140 which protrudes upward acting as another securement for the bridge of the eyeglasses, further retaining the position of the eyeglasses on the A-frame 110 and keeping the eyeglasses from sliding in their position.

Figure 2:
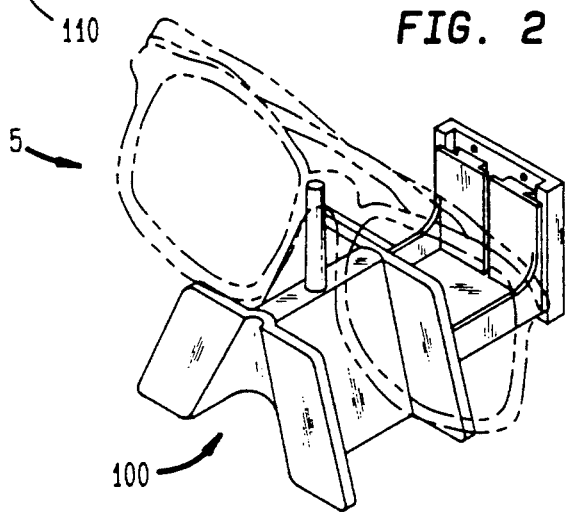
FIG. 2 is a perspective view of the eyeglass holder with eyeglasses retained on the nosepiece.

Referring to FIG. 2, a typical set of eyeglasses 5 are shown. The eyeglasses 5 are seated on the nosepiece 100, with the temples of the eyeglasses 5 neatly folded in back. The present invention is designed to adapt to a plurality of various sizes and styles of eyeglasses 5.

Figure 3:
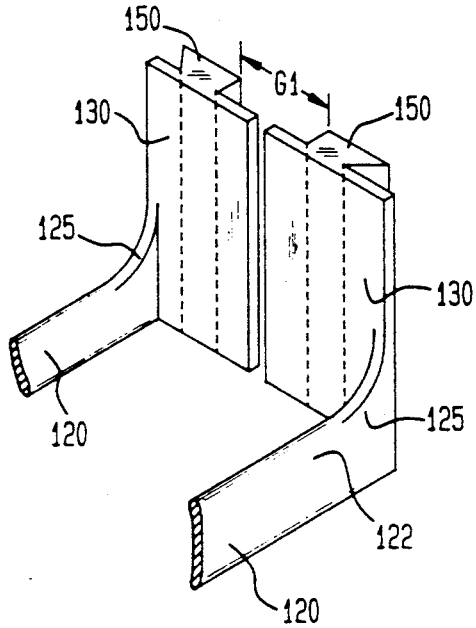
FIG. 3 is a perspective view of the rectangular plates and interlocking wedge structures connected to the nosepiece by a pair of shafts.

Referring to FIG. 3, a perspective view of the rectangular plates 130 portion of the nosepiece 100 is shown. There is a widened stem 125 section of the shafts 120 which joins to the surface of the rectangular plates 130. The widened stem 125 provides structural support to the connection between the shafts 120 by bracing the surface of the rectangular plates 130 to the additional surface area along the upper shaft surface 122 of the shafts 120.

Disposed on the surface of the rectangular plates 130, there are a pair of wedge interlocks 150 which are utilized for the detachable coupling. While the rectangular plates 130 are not compressed, there is an uncompressed gap G1 between the rectangular plates. For the rectangular plates 130 to be compressed, the plastic deformation actually occurs at the slight bending of the shafts 120. The plastic material is resilient enough to come back to its original shape after it is compressed, maintaining the uncompressed gap G1 spacing between the rectangular plates 130.

Figure 4:
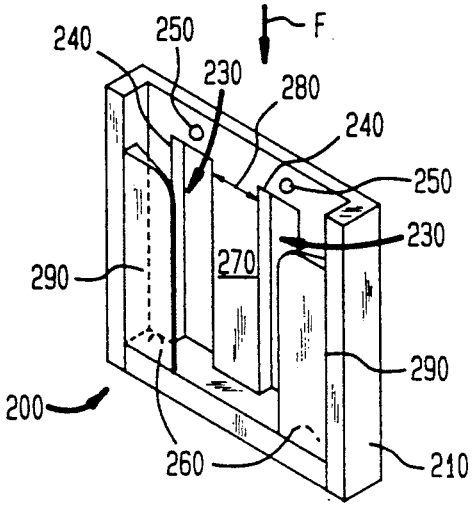
FIG. 4 is a perspective view of the flat base and channels to receive the interlocking wedge structures of the nosepiece.

Referring to FIG. 3 and FIG. 4, the interlocking members are shown. Specifically, the interlocking members are the rectangular plates 130 and wedge interlocks 150 which fit to the channels 230 within the rectangular frame of the flat base 200. The flat base 200 has a pair of channels 230 and corresponding channel overhang 290 structures which dovetail the wedge interlocks 150 and rectangular plates 130, to form the detachable coupling.

There are two channel entrance locations 240 where the wedge interlocks 150 can slide into the channels 230. Each channel overhang 290 should guide the wedge interlocks 150 through the channels 230, until the wedge interlocks 150 reach the channel stop wall 260. As the wedge interlocks 150 are slid into the channels 230, they are slid over the small hemispheric dots 250 disposed above the channel entrance locations 240 of the channels 230. When the wedge interlocks 150 are almost completely in the channels 230, they are locked into place with a click by the small hemispheric dots 250 which block the wedge interlocks 150 from being pulled out.

In this configuration, when the detachable coupling between the wedge interlocks 150 and the channels 230 are formed, the rectangular plates 130 are resting flat, flush against the rectangular frame 210 of the flat base 200 surface. The channel overhang 290 dovetail to the wedge interlocks 150 to prevent excessive play in the interlocking fit.

There is a central channel block 270 disposed between the channels 230 of the flat base 200. The central channel block 270 has a channel gap width 280, wide enough to accommodate an outside overlapping edge of each of the wedge interlocks 150 when they are inserted into the channels 230. The interlocking fit between the flat base 200 and the wedge interlocks 150 of the rectangular plates 130 is accomplished by pushing the wedge interlocks 150 into the flat base 200 in a forward F direction. By pushing the wedge interlocks 150 into the channels 230, the rectangular plates 130 are pushed forward F over the surface of the channels 230 and the rectangular plates 130 rest on the rectangular frame 210 of the flat base 200.

The flat surface of the wedge interlocks 150 rest partially on the central channel block 270. The wedge interlocks 150 fit to each of the channels 230, and are held by the dovetail of the channel overhang 290. Once the wedge interlocks 150 are pushed completely into the channel 230, they cannot slide forward F because of the channel stop wall 260. And, the wedge interlocks 150 are prevented from sliding out by the hemispheric dots 250 in front of the channel entrance 240.

Figure 5:
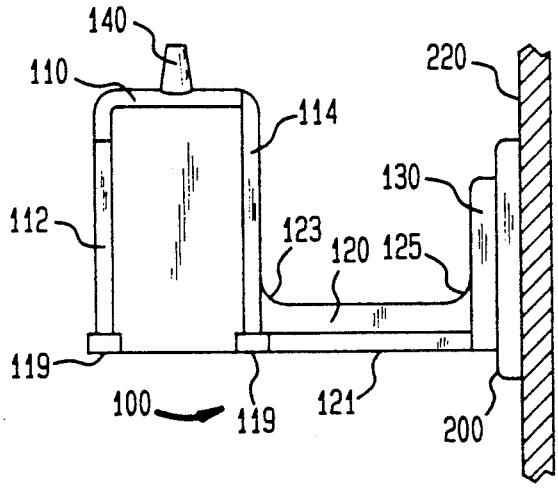
FIG. 5 is a side view of the nosepiece connected to the flat base which is mounted to a surface.

Referring to FIG. 5, the flat base 200 and nosepiece 100 of the eyeglass holder is shown from a side view. The flat base 200 is joined to a mounting surface 220. There can be a multiplicity of eyeglass holders which are joined to the mounting surface 220. The flat base 200 could be glued to the mounting surface 220 in spaced apart intervals which could accommodate a multiplicity of eyeglasses. The flat base 200 structures could be prepared for the mounting surface 220 in such configurations as larger plates which fit into an attractive display case. Various display case arrangements, including eyeglass holder trees and pivoting racks, could be adapted to the flat base 200 structures. The nosepiece 100 is designed to accommodate a multiplicity of eyeglasses of various sizes and styles which the eyeglass retailer would have available in stock.

The A-frame 110 structure is shown supported by the shafts 120 which extend from the rectangular plates 130. The shafts 120 are oriented perpendicular to the surface of the rectangular plates 130. The widened stem 125 provides additional bracing at the connection of the shafts 120 to the rectangular plates 130. Similarly, the widened shaft join 123 at the opposite end of the shafts 120, enhances the strength of the connection between the shaft and the lower part of the A-frame, through an intermediate connection to part of the rear flare plates 114.

There is also a shaft bevel 121 at the lower part of the shaft 120. The shaft bevel 121 tends to round out the edges of the shaft 120, making it easier to handle by avoiding sharp edges. In general, all of the edges of the shaft 120 are rounded. There is a plate bevel 119 at the forward flare plate 112 and the rear flare plate 114 which also avoids a pointed edge or sharp corner. In fact, all of the edges and corners of the present invention have been finely rounded to provide a high quality product which is safe to handle.

To prevent the eyeglasses from slipping forward, there are forward flare plates 112 and to prevent the eyeglasses from slipping back, toward the rectangular plates 130, there are rear flare plates 114. The pinnacle 140 additionally prevents sliding and can be very useful in various designs of eyeglasses to position the eyeglasses securely.

Figure 6:
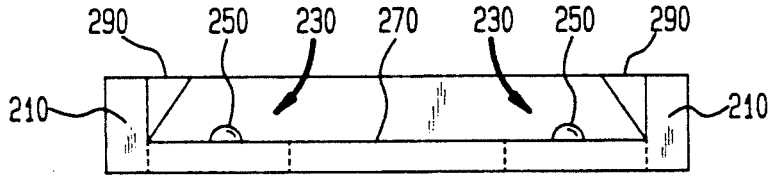
FIG. 6 is a top plan view of the flat base.
Figure 7:
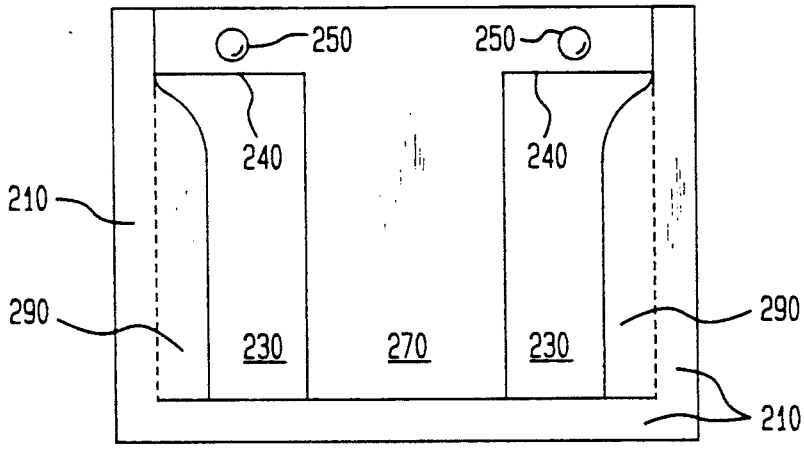
FIG. 7 is a front side view of the flat base.

Referring to FIGS. 6 and 7, there is shown a top plan view and a corresponding front side view of the flat base 200. The top plan view of the flat base 200 shows that the channel overhang 290 generally has a triangular prismatic configuration, and is extending partially over the channels 230 with the same flat plane surface as the rectangular frame 210. The central channel block 270, is centrally located between the two channels 230. The small hemispheric dots 250 are generally disposed near the channel entrance 240. The corresponding front side view of the flat base 200 shows that the small hemispheric dots 250 generally block exit from the channels 230. The channel overhangs 290 are flat at the top surface, and have an inward sloping as they recede into the channels 230. The solid, central channel block 270 is at the lower centralized location between the two channels 230.

Figure 8:
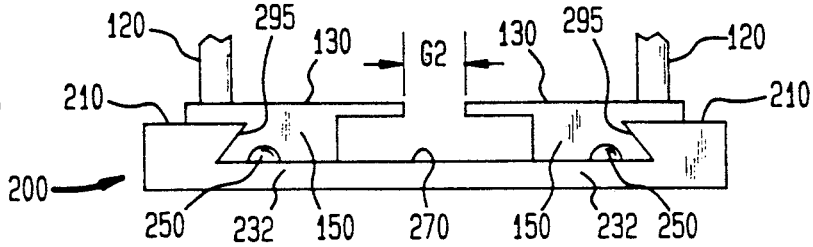
FIG. 8 is a top plan view of the coupling of the nosepiece and the flat base.

Referring to FIG. 8, there is shown the coupling of the flat base 200 and the nosepiece 100, where the wedge interlocks 150 are fit into the channels 230. The wedge interlocks 150 and the triangular prismatic channel overhangs 290 are respectively engaged along two inclined vertical planes 295. There could be a slight compression to the fit between the wedge interlocks 150 of the rectangular plates 130 and the channels 230 of the flat base 200, such that there is a compressed gap spacing G2 between the two rectangular plates 130. In the fit position, the wedge interlocks 150 and rectangular plates 130 combined, could be exactly fit, or fit slightly compressively as they are disposed in the channels 230. Nevertheless, the fit is snug. A slight compression to the fit reduces lateral play by applying a tension on the members which restrict action outward. The tension force would be derived from the resilience of the slightly bent deformable plastic at the shafts 120.

Figure 9:
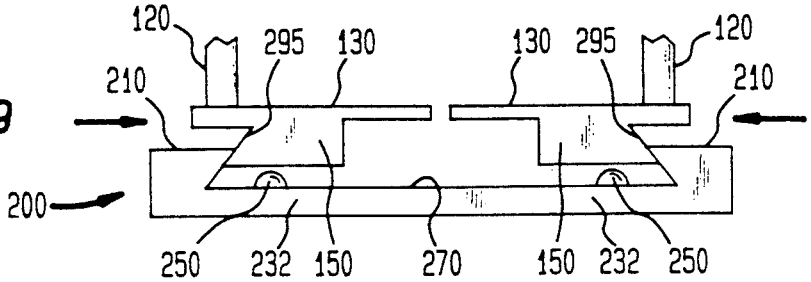
FIG. 9 is a top plan view of the detaching of the nosepiece and the flat base.
Figure 10:
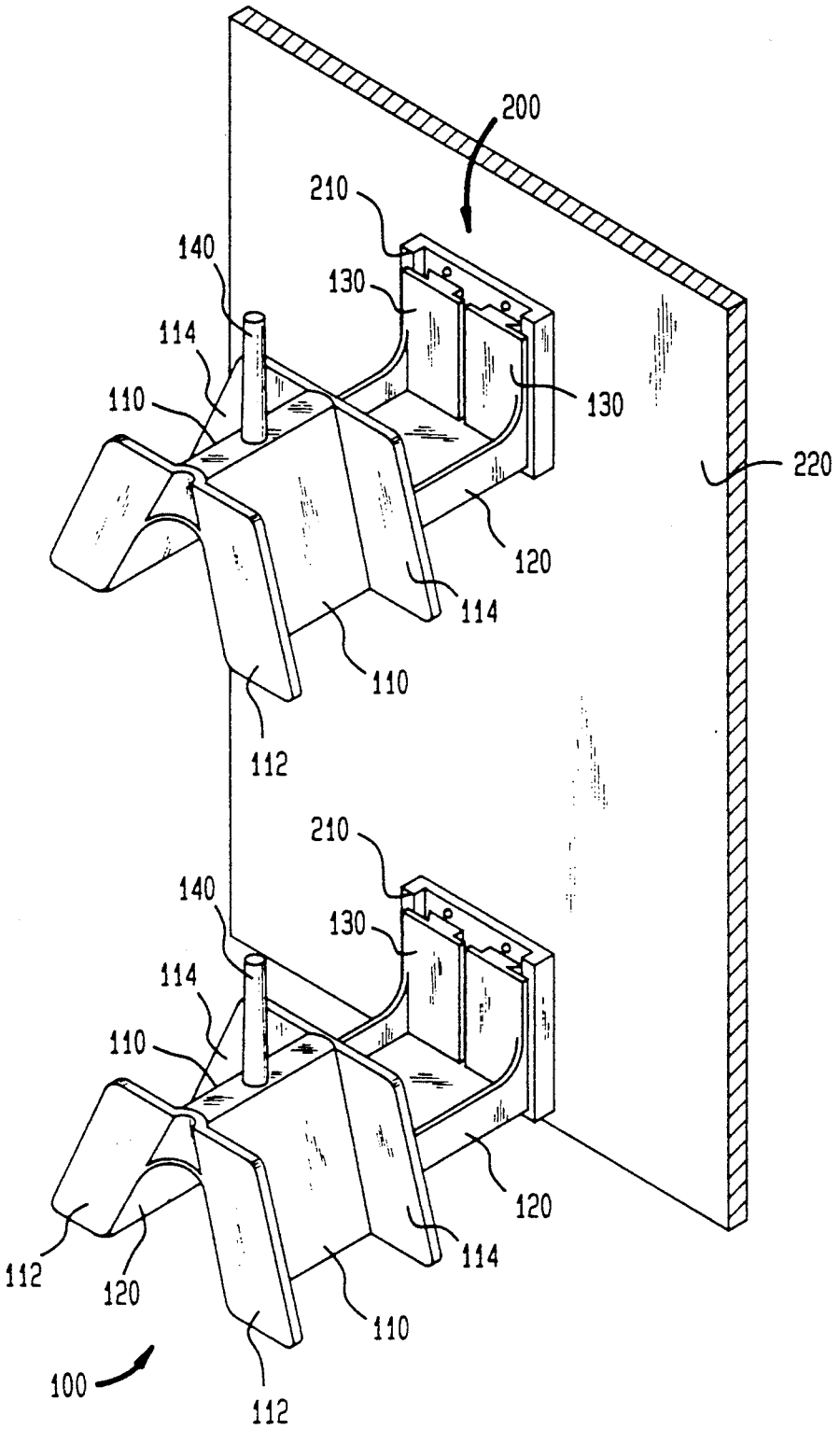
FIG. 10 is a perspective view of an eyeglass display including a plurality of the eyeglass holders of the present invention.

Referring to FIG. 9, to easily withdraw the wedge interlocks 150 of the rectangular plates 130 from the channels 230, the two rectangular plates 130 are squeezed together. The squeezing action causes the wedge interlocks 150 to shift along the two inclined vertical engagement planes 295 and are lifted above the small hemispherical dots 250. In this manner, the wedge interlocks 150 are shifted up, above the hemispheric dots 250 so that the wedge interlocks 150 are not blocked by the hemispheric dots and are easily withdrawn.

In the fit position, the rectangular plates 130 rest partially on the rectangular frame 210 and channel overhangs 290. The flat surface of the wedge interlocks 150 rest partially on the central channel block 270. There are framed openings 232 through the region below the channel 230. These framed openings 232 are regions which vent through, and are disposed to the side of the central channel block 270.

It is appreciated that although the structure of the flat base 200 has been described as having two channels 230, it can be considered as having one extended flat channel since there is really nothing that separates the two channels 230 in the preferred embodiment of the present invention. In other words, the structure of the flat base may be described as having a front surface and a back surface, where the back surface is flat for affixing to the large flat surface 220, and the front surface has two channels 230 each having an overhang 290, or alternatively, one extended flat channel having two opposite overhangs.

Defined in detail, the present invention is an eyeglass holder attachable to a flat vertical surface for displaying eyeglasses, comprising: (a) a unitary nosepiece detachably interlocked with a unitary flat vertical base; (b) said flat vertical base comprising a front surface and a back surface, the back surface being flat for affixing to said flat vertical surface, and the front surface having an extended vertical channel with a top entrance and two oppositely disposed triangular prismatic shaped vertical channel overhangs; (c) said nosepiece comprising a front portion and a rear portion, the front portion including an A-shaped frame structure for retaining a set of eyeglasses in a suspended position, the rear portion including a pair of interlocking wedges which can be slid into said front channel of said flat base through said top entrance; (d) said nosepiece further comprising two horizontal shafts each integrally interconnecting one of said pair of interlocking wedges respectively to said A-shaped frame structure, such that said pair of interlocking wedges are disposed side by side vertically; (e) said interconnecting shafts having tensions to keep said pair of interlocking wedges in a spaced apart relationship with a gap in between, such that said pair of interlocking wedges will frictionally engage with said triangular prismatic shaped channel overhangs along two inclined vertical surfaces respectively; (f) said flat vertical base further comprising a pair of hemispheric protrusions disposed at said top entrance of said front channel for locking said pair of interlocking wedges into said channel to prevent them from sliding out of said channel; and (g) said gap between said pair of interlocking wedges allowing them to be squeezed toward each other by applying inward forces on said interconnecting shafts of said nosepiece, causing said pair of interlocking wedges to shift along said two inclined vertical surfaces respectively to thereby avoid said pair of hemispheric locking protrusions respectively, such that said pair of interlocking wedges are unlocked and can be slid-out and removed from said front channel of said flat base; (h) whereby said flat base and said nosepiece are two separate articles which can be independently manufactured, stored and transported, once said flat base is affixed to said flat vertical surface, said nosepiece can be detachably attached to said flat base to form said eyeglass holder for displaying said eyeglasses in said suspended position.

Defined also in detail, the present invention is a displaying apparatus attachable to a large flat vertical surface for displaying a multiplicity of eyeglasses simultaneously, comprising: (a) a multiplicity of unitary nosepieces and a multiplicity of unitary flat vertical bases; (b) each one of said multiplicity of flat bases comprising a respective front surface and a respective back surface, the back surface being flat for affixing to said large flat vertical surface, and the front surface having a respective vertical channel with a respective top entrance and two respective vertical triangular prismatic shaped channel overhangs; (c) each one of said multiplicity of said nosepieces comprising a respective front portion and a respective rear portion, the front portion including a respective A-shaped frome structure for retaining a respective one of said multiplicity of eyeglasses in a suspended position, the rear portion including a respective pair of interlocking wedges which can be slid into said respective front channel of a respective one of said multiplicity of flat bases; (d) each one of said multiplicity of nosepieces further comprising two respective horizontal shafts each integrally interconnecting one of said respective pair of interlocking wedges respectively to said respective A-shaped frame structure, such that said respective pair of interlocking wedges are disposed side by side vertically; (e) said respective interconnecting shafts of each one of said multiplicity of nosepieces having tensions to keep said respective pair of interlocking wedges in a spaced apart relationship with a respective gap in between, such that said respective pair of interlocking wedges will frictionally engage with said respective triangular prismatic shaped channel overhangs along two respective inclined vertical surfaces respectively; (f) each one of said multiplicity of flat vertical bases further comprising a respective pair of hemispheric protrusions disposed at said respective top entrance of said respective front channel for locking said respective pair of interlocking wedges of a respective one of said multiplicity of nosepieces into said channel to prevent said respective pair of interlocking wedges from sliding out of said respective channel; and (g) said respective gap between said respective pair of interlocking wedges of said respective one of said multiplicity of nosepieces allowing said respective pair of interlocking wedges to be squeezed toward each other by applying inward forces on said respective interconnecting shafts, causing said respective pair of interlocking wedges to shift along said two respective inclined vertical surfaces respectively to thereby avoid said respective pair of hemispheric locking protrusions respectively, such that said respective pair of interlocking wedges of said respective one of said multiplicity of nosepieces are unlocked and can be slid-out and removed from said respective front channel of said respective one of said multiplicity of flat bases; (h) whereby said multiplicity of flat bases and said multiplicity of nosepieces are two separate groups of articles which can be independently manufactured, stored and transported, once said multiplicity of flat bases are affixed to said large flat vertical surface, said multiplicity of nosepieces can be interchangeably attached to said multiplicity of flat bases respectively to form a multiplicity of eyeglass holders for displaying said multiplicity of eyeglasses simultaneously.

Defined alternatively in detail, the present invention is an eyeglass holder attachable to a flat vertical surface for displaying eyeglasses, comprising: (a) a unitary nosepiece detachably interlocked with a unitary flat vertical base; (b) said flat base comprising a front surface and a back surface, the back surface being flat for affixing to said flat vertical surface, and the front surface having a pair of vertical channels, each one of the pair of vertical channels having a top entrance and an outward triangular prismatic shaped vertical channel overhang; (c) said nosepiece comprising a front portion and a rear portion, the front portion including an A-shaped frame structure for retaining a set of eyeglasses in a suspended position, the rear portion including a pair of interlocking wedges which can be slid respectively into said pair of front channels of said flat base through their respective top entrance; (d) said nosepiece further comprising two horizontal shafts each integrally interconnecting one of said pair of interlocking wedges respectively to said A-shaped frame structure, such that said pair of interlocking wedges are disposed side by side vertically; (e) said interconnecting shafts having tensions to keep said pair of interlocking wedges in a spaced apart relationship, such that each one of said pair of interlocking wedges will frictionally, engage with said triangular prismatic shaped channel overhang of a respective one of said pair of front channels; (f) said flat base further comprising a pair of hemispheric protrusions disposed respectively at said top entrances of said pair of front channels for locking said pair of interlocking wedges into said pair of front channel respectively to prevent them from sliding out of said pair of front channels; and (g) said pair of front channels each further having adequate clearance for allowing said pair of interlocking wedges to be squeezed toward each other by applying inward forces on said interconnecting shafts of said nosepiece, causing said pair of interlocking wedges to shift to thereby avoid said pair of hemispheric locking protrusions respectively, such that said pair of interlocking wedges are unlocked and can be slid-out and removed from said pair of front channels of said flat base; (h) whereby said flat base and said nosepiece are two separate articles which can be independently manufactured, stored and transported, once said flat base is affixed to said flat vertical surface, said nosepiece can be detachably attached to said flat base to form said eyeglass holder for displaying said eyeglasses in said suspended position.

Defined broadly, the present invention is an eyeglass holder attachable to a flat surface for displaying eyeglasses, comprising: (a) a unitary nosepiece detachably interlocked with a unitary flat base; (b) said flat base comprising a front surface and a back surface, the back surface being flat for affixing to said flat surface, and the front surface having an channel with an entrance at one side and channel overhangs at other sides; (c) said nosepiece comprising a front portion and a rear portion, the front portion including an A-shaped frame structure for retaining a set of eyeglasses, the rear portion including two interlocking members which can be slid into said front channel of said flat base through said entrance; (d) said nosepiece further comprising two integral shafts each interconnecting one of said two interlocking members respectively to said A-shaped frame structure, such that said two interlocking members are disposed side by side; (e) said interconnecting shafts having tensions to keep said two interlocking members in a spaced apart relationship with a gap in between, such that said pair of interlocking members can be snugly engaged within said front channel of said flat base; (f) said flat base further comprising two small protrusions disposed at said entrance of said front channel for locking said two interlocking members into said channel to prevent them from sliding out of said channel; and (g) said gap between said two interlocking members allowing them to be squeezed toward each other, causing them to shift and thereby avoid said two locking protrusions respectively, such that said two interlocking members are unlocked and can be slid-out and removed from said front channel of said flat base; (h) whereby said flat base and said nosepiece are two separate articles which can be independently manufactured, stored and transported, once said flat base is affixed to said flat surface, said nosepiece can be detachably attached to said flat base to form said eyeglass holder for displaying said eyeglasses.

Defined also broadly, the present invention is a displaying apparatus attachable to a large surface for displaying a multiplicity of eyeglasses, comprising: (a) a multiplicity of nosepieces and a multiplicity of base pieces; (b) each one of said multiplicity of base pieces having a respective back surface for affixing to said large surface, and a front channel with a respective entrance and respective channel overhangs; (c) each one of said multiplicity of said nosepieces comprising a respective frame structure for retaining a respective one of said multiplicity of eyeglasses, and a respective interlocking member which can be slid into said respective front channel of a respective one of said multiplicity of base pieces; (d) each one of said multiplicity of base pieces further comprising respective small protrusions disposed at said respective entrance of said respective front channel for locking said respective interlocking member of a respective one of said multiplicity of nosepieces into said channel to prevent said respective interlocking member from sliding out of said respective front channel; and (e) said respective interlocking member having a respective split for allowing snug fitting with said front channel of said respective one of said multiplicity of base pieces and permitting flexibility of shifting to avoid said respective locking protrusion respectively, such that said respective interlocking member of said respective one of said multiplicity of nosepieces is unlocked and can be thereby slid-out and removed from said respective front channel of said respective one of said multiplicity of base pieces; (f) whereby said multiplicity of base pieces and said multiplicity of nosepieces are two separate groups of articles which can be independently manufactured, stored and transported, once said multiplicity of base pieces are affixed to said large surface, said multiplicity of nosepieces can be interchangeably attached to said multiplicity of base pieces respectively to form a multiplicity of eyeglass holders for displaying said multiplicity of eyeglasses simultaneously.

Defined more broadly, the present invention is an eyeglass holder, comprising: (a) a nosepiece and a separate base piece; (b) said base piece having an exposed channel with an entrance and channel overhangs; (c) said nosepiece comprising a frame structure for retaining a set of eyeglasses and an interlocking member which can be slid into said channel of said base piece through said entrance; (d) means for locking said interlocking member of said nosepiece within said channel of said base piece; and (e) means for unlocking said interlocking member of said nosepiece from said channel of said base piece; (f) whereby said base piece and said nosepiece are two separate articles which can be independently manufactured, stored and transported, said nosepiece can be detachably attached to said base piece to form said eyeglass holder for displaying said eyeglasses.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An eyeglass holder, comprising a base;

a nosepiece for supporting a pair of eyeglasses;

connecting means for removably connecting said nosepiece to said base, said connecting means including an interlocking member formed on one of said base and said nosepiece and having a pair of opposed edges, a receiving channel formed on the other one of said base and said nosepiece and having a pair of opposed sidewalls and an open end for receiving said interlocking member in a sliding direction in an assembled position of said connecting means, and a resilient member connected to a selected one of said base and said nosepiece, said resilient member being biased to a first position and movable to a second position; and retaining means on either one of said base and said nosepiece for locking said connecting means in said assembled position, said retaining means blocking movement of said interlocking member out from said receiving channel when said resilient member is in said first position, and said retaining means permitting movement of said interlocking member out from said receiving channel when said resilient member is in said second position.

2. The eyeglass holder as claimed in claim 1, wherein said resilient member is connected to said interlocking member so that said opposed edges are separated by a first distance in said first position of said resilient member and are separated by a second distance less than said first distance in said second position of said resilient member.

3. The eyeglass holder as claimed in claim 2, wherein said interlocking member includes a first portion having one of said pair of opposed edges, a second portion having another of said pair of opposed edges, and said resilient member connected between said first and second portions.

4. The eyeglass holder as claimed in claim 2, wherein said receiving channel and said interlocking member together define at least one pair of engageable surfaces, said surfaces being in mutual engagement in said first position of said resilient member to block movement of said base and said nosepiece away from one another in a direction transverse to said sliding direction, said surfaces being out of mutual engagement upon movement of said resilient member to said second position so that said base and said nosepiece are movable away from one another in said transverse direction.

5. The eyeglass holder as claimed in claim 4, wherein said engageable surfaces include a dovetail connection between said receiving channel and said interlocking member.

6. The eyeglass holder as claimed in claim 1, wherein said retaining means is disposed at said open end of said receiving channel.

7. The eyeglass holder as claimed in claim 6, wherein said retaining means comprise at least one protruding member disposed at said open end of said receiving channel.

8. The eyeglass holder as claimed in claim 1, wherein said nosepiece includes a frame structure and a pinnacle projecting upwardly from said frame structure for supporting the pair of eyeglasses in a display position.

9. The eyeglass holder as claimed in claim 8, wherein said frame structure includes a front flange for preventing forward movement of the pair of eyeglasses with respect to said frame structure.

10. The eyeglass holder as claimed in claim 9, wherein said frame structure further includes a rear flange for preventing rearward movement of the pair of eyeglasses with respect to said frame structure.

11. An eyeglass display, comprising a support member; and a plurality of eyeglass holders connected to said support member, each one of said plurality of eyeglass holders including a base attached to said support member, a nosepiece for supporting a pair of eyeglasses, connecting means for removably connecting said nosepiece to said base, said connecting means including an interlocking member formed on one of said base and said nosepiece and having a pair of opposed edges, a receiving channel formed on the other one of said base and said nosepiece and having a pair of opposed sidewalls and an open end for receiving said interlocking member in a sliding direction in an assembled position of said connecting means, and a resilient member connected to a selected one of said base and said nosepiece, said resilient member being biased to a first position and movable to a second position, and retaining means on either one of said base and said nosepiece for locking said connecting means in said assembled position, said retaining means blocking movement of said interlocking member out from said receiving channel when said resilient member is in said first position, and said retaining means permitting movement of said interlocking member out from said receiving channel when said resilient member is in said second position.

12. The eyeglass display as claimed in claim 11, wherein said resilient member is connected to said interlocking member so that said opposed edges are separated by a first distance in said first position of said resilient member and are separated by a second distance less than said first distance in said second position of said resilient member.

13. The eyeglass display as claimed in claim 12, wherein said interlocking member includes a first portion having one of said pair of opposed edges, a second portion having another of said pair of opposed edges, and said resilient member connected between said first and second portions.

14. The eyeglass display as claimed in claim 12, wherein said receiving channel and said interlocking member together define at least one pair of engageable surfaces, said surfaces being in mutual engagement in said first position of said resilient member to block movement of said base and said nosepiece away from one another in a direction transverse to said sliding direction, said surfaces being out of mutual engagement upon movement of said resilient member to said second position so that said base and said nosepiece are movable away from one another in said transverse direction.

15. The eyeglass display as claimed in claim 14, wherein said engageable surfaces include a dovetail connection between said receiving channel and said interlocking member.

16. The eyeglass display as claimed in claim 11, wherein said retaining means is disposed at said open end of said receiving channel.

17. The eyeglass display as claimed in claim 16, wherein said retaining means comprise at least one protruding member disposed at said open end of said receiving channel.

18. The eyeglass display as claimed in claim 11, wherein said nosepiece includes a frame structure and a pinnacle projecting upwardly from said frame structure for supporting the pair of eyeglasses in a display position.

19. The eyeglass display as claimed in claim 18, wherein said frame structure includes a front flange for preventing forward movement of the pair of eyeglasses with respect to said frame structure.

20. The eyeglass display as claimed in claim 19, wherein said frame structure further includes a rear flange for preventing rearward movement of the pair of eyeglasses with respect to said frame structure.

* * * * *